United States Patent [19]

Cuschera

[11] 4,261,824

[45] Apr. 14, 1981

[54] FLOOR DRAIN

[76] Inventor: Casper Cuschera, 800 Durham Rd., Fremont, Calif. 94538

[21] Appl. No.: 2,936

[22] Filed: Jan. 12, 1979

[51] Int. Cl.[3] ..... E03F 5/06

[52] U.S. Cl. ..... 210/164; 4/289

[58] Field of Search ..... 4/286–289; 210/163–166, 247, 459

[56] References Cited

U.S. PATENT DOCUMENTS

| | | | |
|---|---|---|---|
| 2,003,770 | 6/1935 | Goodbart | 210/163 |
| 3,040,895 | 6/1962 | Sisk | 210/164 |
| 3,411,628 | 11/1966 | Mason | 210/163 |
| 3,713,539 | 1/1973 | Thompson et al. | 210/164 |
| 4,035,297 | 7/1977 | Aldridge et al. | 210/163 |

*Primary Examiner*—Thomas G. Wyse

*Attorney, Agent, or Firm*—Harris Zimmerman

[57] ABSTRACT

A floor drain for showers or the like includes a cylindrical drain body having an externally threaded upper portion and a flange extending radially outwardly from the upper end thereof. A threaded nut is secured to the externally threaded portion and opposed to the flange for clamping the floor therebetween. The lower portion of the drain body comprises a concentric cylindrical member of smaller diameter joined to the upper portion by an annular shoulder. The inside diameter of the lower portion is dimensioned to receive a standard drain pipe. An inner strainer is provided to rest on the interior surface of the annular shoulder, and an outer strainer is snappingly secured in an annular groove adjacent to the upper end of the bore in the drain body. Alternatively, a spider may be permanently secured in place of the inner strainer.

6 Claims, 5 Drawing Figures

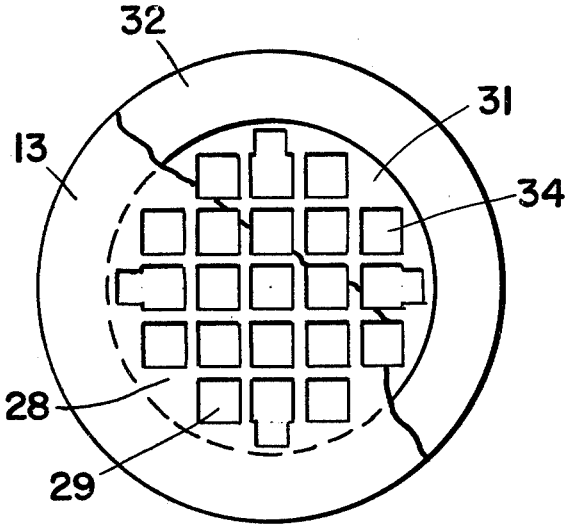
FIG_1
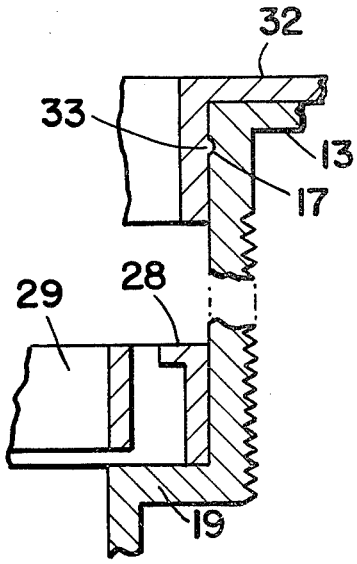
FIG_3
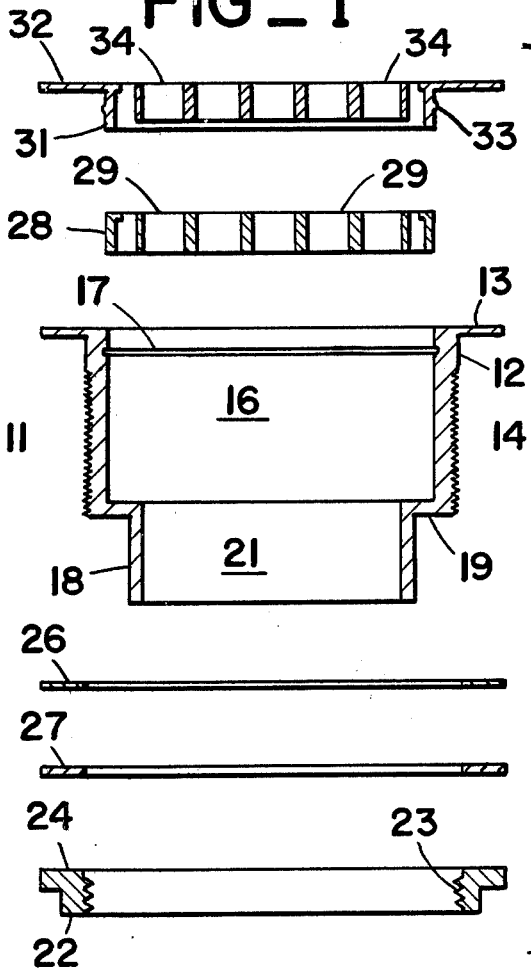
FIG_2
FIG_5
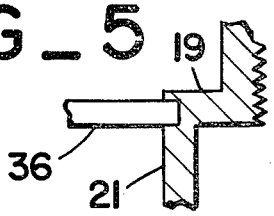
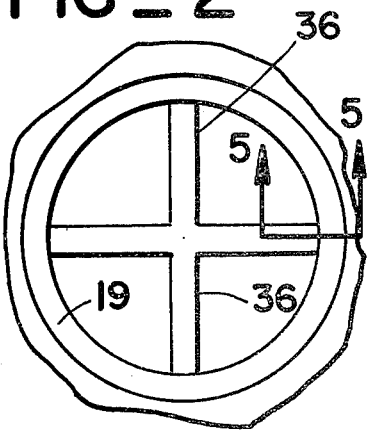
FIG_4

FLOOR DRAIN

BACKGROUND OF THE INVENTION

In the insulation of floor drains there is an obvious need for the upper surface of the drain to be flushed with the floor surface so that all liquid may be drained from the floor surface. Prior art drain fittings, especially those molded from plastic or resin materials, include a portion which engages the end of the discharge pipe to effect a leak-proof seal therewith. Generally, this portion comprises an inwardly extending flange in the bore of the drain fitting. In order that the upper end of the discharge pipe may be disposed substantially flush with the inner flange, the length of the discharge pipe must fall within a very narrow tolerance. If that tolerance is not met, the inner flange will rest on the upper end of the discharge pipe but the upper end of the drain will not be flush with the floor surface. The labor and skill involved in meeting the close tolerances of these drain fittings is a significant cost in plumbing installation.

Another problem encountered in the prior art drain fittings is that a substantial amount of solid matter passes through the drain fitting and subsequently lodges in a portion of the discharge pipe, usually the trap immediately below the drain fitting. Drain fittings have commonly been provided with strainers to catch the larger pieces of solid matter carried by the waste water. Often, however, sufficient solid matter passes through the strainer to clog the drain, requiring expensive cleaning and repair of the plumbing system.

SUMMARY OF THE PRESENT INVENTION

The present invention generally comprises a floor drain for showers and the like which is characterized by its acceptance of discharge pipes having a wider range of spacing from the floor surface in which the drain is installed. Furthermore, the floor drain of the present invention is provided with two strainers to remove more of the solid material from the waste water and thereby reduce the potential for clogged discharged pipes.

The drain fitting of the present invention includes a cylindrical drain body having a flange extending radially outwardly from the upper end thereof. The outer surface of the drain body is provided with external threads which receive a nut thereon. A pair of gaskets are disposed between the nut and the opposed flange, and the compression provided by the nut urges the gaskets into sealing engagement with the floor surface in which the drain is installed.

A lower portion of the drain body includes a concentric cylindrical member having a smaller diameter than the upper portion of the drain fitting. The inner diameter of the lower portion is dimensioned to receive a standard drain pipe with sliding clearance. The lower portion of the drain body is joined to the upper portion by an annular shoulder, and an inner strainer is supported by the inner surface of the annular shoulder. A second, upper strainer is snappingly secured in an annular groove which is disposed in the upper end portion of the bore extending through the drain body.

In an alternative embodiment, the inner strainer is deleted, and a spider is permanently secured in the bore of the lower portion of the drain body.

A BRIEF DESCRIPTION OF THE DRAWING

FIG. 1 is a partially cutaway top view of one embodiment of the drain fitting of the present invention.

FIG. 2 is an exploded view of the embodiment of the drain fitting shown in FIG. 1.

FIG. 3 is an enlarged cross-sectional view of a portion of the embodiment of the drain fitting shown in FIG. 1.

FIG. 4 is a cutaway top view of a further embodiment of the drain fitting of the present invention.

FIG. 5 is an enlarged cross-sectional view of a portion of the further embodiment, taken along line 5—5 of FIG. 4.

DESCRIPTION OF THE PREFERRED EMBODIMENT

The present invention generally comprises a drain fitting for use as a floor drain, shower drain, and the like. As shown in FIG. 2, one embodiment of the present invention includes a drain body 11 having an upper cylindrical portion 12. Extending radially outwardly from the upper end of the cylindrical portion 12 is a flange 13. External threads 14 are provided on the exterior surface of the cylindrical portion 12. A bore 16 extends through the upper cylindrical portion 12, and an annular groove 17 is formed in the surface of the bore 16 adjacent to the upper end thereof.

The drain body 11 includes a lower cylindrical portion 18 which is smaller in diameter than the upper portion 12. The lower portion 18 is joined to the upper portion 12 by an annular shoulder 19. The lower portion 18, which is concentric with the upper portion 12 includes a bore 21 extending therethrough concentric with the bore 16. The bore 21 is dimensioned to receive a standard waste pipe with a sliding fit.

The invention also includes a nut 22 having internal threads 23 which are adapted to engage the external threads 14 of the upper portion 12. The nut 22 includes an upper annular surface 24 which is in opposition to the lower surface of the flange 13 when the nut 22 is threaded onto the threads 14. A gasket 26 and a washer 27 are provided to be assembled onto the upper portion 12 intermediate of the flange 13 and the nut 22. When assembled, the floor portion through which the drain fitting is installed is disposed between the flange 13 and the gasket 26, with the nut 22 impinging on the washer 27 and the gasket 26 to effect a seal with the floor portion.

The drain fitting also includes an inner strainer member 28 which generally comprises a cylindrical disc having a diameter slightly less than the diameter of the bore 16. The strainer member 28 is provided with a plurality of holes 29 extending therethrough, and the strainer member 28 is adapted to rest on the inner surface of the annular shoulder 19.

The invention includes a second strainer member 31 which also comprises a cylindrical disc having a diameter slightly less than that of the bore 16. A flange 32 extends radially outwardly from the strainer member 31, and is adapted to impinge on the upper surface of the flange 13 of the drain body 11. An annular rib 33 extends radially outwardly from the strainer member 31, and is provided to snappingly engage the annular groove 17 in the bore 16, as shown in FIG. 3. The strainer member 31 includes a plurality of holes 34 through which the waste water may pass, although large particles of solid waste will be retained thereby.

Although in the preferred embodiment the holes 29 and 34 depicted as being substantially equal in size, it may be appreciated that the holes 29 may be made smaller to retain solid waste particles which pass through the holes 34.

In alternative form of the present invention, all of the parts enumerated in the foregoing are present, except for the inner strainer member 28. As shown in FIGS. 4 and 5, a spider 36 is secured in the upper end of the bore 21, adjacent to the annular shoulder 19. Although the spider 36 is depicted as having four arms which are orthogonally related, it may be appreciated that any number of arms may be provided. The spider 36 prevents large objects from passing through the bore 21 when the upper strainer 31 is removed from the drain assembly.

It should be noted that in either embodiment of the present invention, the drain fitting is installed in a floor so that the upper surface of the flange 32 is substantially flush with the floor surface. Further, the waste or discharge pipe to which the fitting is secured is disposed so that the upper end of the pipe is received in the bore 21. The upper end of the discharge pipe may be received at any axial position within the bore 21, and is secured therein by adhesive material.

I claim:

1. A floor drain assembly for connection to a waste pipe, comprising a drain body having a generally cylindrical upper portion and a first bore extending axially therethrough, said upper portion including external threads and a first flange extending outwardly from the upper end thereof, a lower portion concentric with said upper portion and having a second bore extending axially therethrough, said second bore having a diameter smaller than said first bore, said second bore diameter being substantially equal to the external diameter of said waste pipe, an annular shoulder joining said first and second bores, first strainer means disposed adjacent to said annular shoulder and supported thereby, said first strainer means being substantially equal in diameter to the diameter of said first bore, and second strainer means secured in the upper end of said bore, said second strainer means including a second strainer removably secured in said first bore, and said second strainer including an annular rib about the circumference thereof, said rib snappingly engaging an annular groove in the upper end of said first bore.

2. The floor drain assembly of claim 1, wherein said first strainer means includes a first strainer removably supported by said annular shoulder.

3. The floor drain assembly of claim 2, wherein said first strainer includes a cylindrical disc having a plurality of holes extending therethrough parallel to the axis thereof.

4. The floor drain assembly of claim 1, wherein said first strainer means includes a spider having a plurality of arms, the distal ends of said arms being secured in said drain body.

5. The floor drain assembly of claim 4, wherein said spider is secured in said second bore.

6. The floor drain assembly of claim 1, wherein said second strainer includes a second flange extending radially outwardly therefrom and impinging on said first flange.

* * * * *